US007549456B2

(12) United States Patent
Preising, Jr.

(10) Patent No.: US 7,549,456 B2
(45) Date of Patent: Jun. 23, 2009

(54) MOVABLE BARRIER ROLLER GUARD

(75) Inventor: Danny L. Preising, Jr., Massillon, OH (US)

(73) Assignee: Wayne-Dalton Corp., Mount Hope, OH (US)

( * ) Notice: Subject to any disclaimer, the term of this patent is extended or adjusted under 35 U.S.C. 154(b) by 395 days.

(21) Appl. No.: 11/287,540

(22) Filed: Nov. 23, 2005

(65) Prior Publication Data

US 2007/0113990 A1 May 24, 2007

(51) Int. Cl.
*E05D 15/00* (2006.01)

(52) U.S. Cl. ..... 160/201; 16/91

(58) Field of Classification Search ..... 160/172 R, 160/201, 207, 209, 84.06; 16/107, 87 R, 16/91, 96 R, 97, 99, DIG. 1; 49/197, 199, 49/201, 460

See application file for complete search history.

(56) References Cited

U.S. PATENT DOCUMENTS 5,528,862 A * 6/1996 Streeter ..... 49/404
6,125,506 A * 10/2000 Martin ..... 16/91
6,227,281 B1 5/2001 Martin ..... 160/201
6,463,989 B1 * 10/2002 Johnson ..... 160/201
6,540,003 B1 * 4/2003 Martin ..... 160/201

FOREIGN PATENT DOCUMENTS

| | | |
|---|---|---|
| WO | WO 99/36632 | 7/1999 |
| WO | WO 02/41758 | 5/2002 |
| WO | WO 03/004217 | 1/2003 |
| WO | WO 03/098096 | 11/2003 |

* cited by examiner

*Primary Examiner*—Katherine W Mitchell
*Assistant Examiner*—Jeremy C Ramsey
(74) *Attorney, Agent, or Firm*—Renner Kenner Greive Bobak Taylor & Weber

(57) ABSTRACT

A door system (10) having, a door (D), a plurality of track sections (16, 17, 18) having a cross-section defining an interior track area (50) that is accessible though an opening (51) therein, a roller (25) received in the interior track area and coupled to a shaft (26) that is operatively interconnected with the door, and a guard (60) carried by the shaft and at least partially enclosing the roller, wherein the guard includes a shield (62) wall that is positioned within the interior track area and at least partially obstructs the opening in the area of the roller.

18 Claims, 4 Drawing Sheets

28
22
42
25
23
27
51
62
65
67
40
66
41
50
30
29
70
61
83
81
71
60
5
24
84
82
26
31
39
β
α
75
64
80
Ø

MOVABLE BARRIER ROLLER GUARD

TECHNICAL FIELD

In general, the present invention relates to movable barriers, such as garage doors. More particularly, the present invention relates a roller guard for such movable barriers to prevent objects, including body parts, from being pinched or crushed. More specifically the present invention relates to a roller guard for doors having door mounted rollers movable in tracks, wherein the roller guard prevents objects from being caught between the rollers and the track.

BACKGROUND OF THE INVENTION

Movable barriers, including garage doors, raise entrapment and entanglement concerns. In particular, open spaces in and around the door and close to the moving parts of the door may allow an object to enter this open space and be pinched or crushed by the moving parts of the door. In the past, objects within the garage including tool handles, clothing, and body parts, such as hands or fingers have been pinched or crushed by the door. Such dangers are a safety concern to users and may interfere with operation of the door. To provide safer door systems, attempts have been made to prevent such entrapment Of particular concern is the possibility of a finger or hand being placed within a track section where it might be crushed or pinched by a roller traversing the track. One existing roller shield design is used in connection with a sectional door in an attempt to alleviate the aforementioned danger. The sectional door includes a plurality of door sections hinged together in edge-to-edge relationship. Support rollers are attached to each door section and confined within a pair of support tracks located on either lateral side of the door. To prevent entrapment between the roller and the track, a circular or rectangular roller shield is mounted on the axle of each support roller outside the track. The shield is placed proximate to the track to prevent fingers from entering the track near the support rollers. In addition to the roller shields, protective shield wings are provided to enclose the support track and prevent objects from interfering with the roller as well as to provide transport guidance where the sections meet. The outer edge of the shield is blunted or protected to prevent harm during operation. Similarly, the edge of the support track includes a folded single hem used to prevent fingers from being cut as they are brushed aside by the roller shield.

Designs with these features have certain disadvantages. For example, because the shields are positioned outside the track they may interfere with other track components. Further, the external shields typically must physically contact the track or be in such close proximity as to intermittently contact the track in order to adequately protect a user from the rollers. When contacting, unwanted friction is created, making it continuously or intermittently more difficult to open and close the sectional door and creating substantial noise.

Therefore, there exists a need in the art to provide a roller guard which provides pinching and crushing protection but does not suffer the normal disadvantages.

SUMMARY OF THE INVENTION

Accordingly, it is an object of the present invention to provide a guard for the roller of a movable barrier which is positioned inside the track of a movable door system. It is a further object of the present invention to provide a guard for a movable door system which does not interfere with door components outside the track assembly. Another object of the invention is to provide such a roller guard that can be used on the bottom roller of a sectional door without affecting the operation or total closing of the door.

It is an additional object of the present invention to provide a roller guard for a movable door system, where the guard is adapted to minimize frictional contact with track components during movement of the door. It is yet another object of the present invention to provide such a guard for a movable door system which is a single molded piece that encloses the roller while having the operative components for shielding substantially entirely within the tracks. It is a still further object of the invention to provide such a roller guard that may be structurally adapted to operate with a variety of configurations of track assemblies and rollers employed in the industry and does not require track having a hemmed edge.

These and other objects of the present invention, as well as the advantages thereof over existing prior art guards, which will become apparent from the description to follow, are accomplished by the improvements hereinafter described and claimed.

In general, the present invention contemplates a door system having, a door, a plurality of track sections having a cross-section defining an interior track area that is accessible though an opening therein, a roller received in the interior track area and coupled to a shaft that is operatively interconnected with the door, and a guard carried by the shaft and at least partially enclosing the roller, wherein the guard includes a shield wall that is positioned within the interior track area and at least partially obstructs the opening in the area of the roller.

DETAILED DESCRIPTION OF THE INVENTION

A roller guard according to the concepts of the present invention, generally indicated by the numeral 60 in the accompanying drawings, is used in connection with a movable barrier, such as a garage door system, generally indicated by the numeral 10 in the accompanying drawings. Since the roller guard 60 may be used in connection with a number of different door systems 10, only general reference will be made to the door system components other than those directly involved with the roller guard 60.

Figure 1:
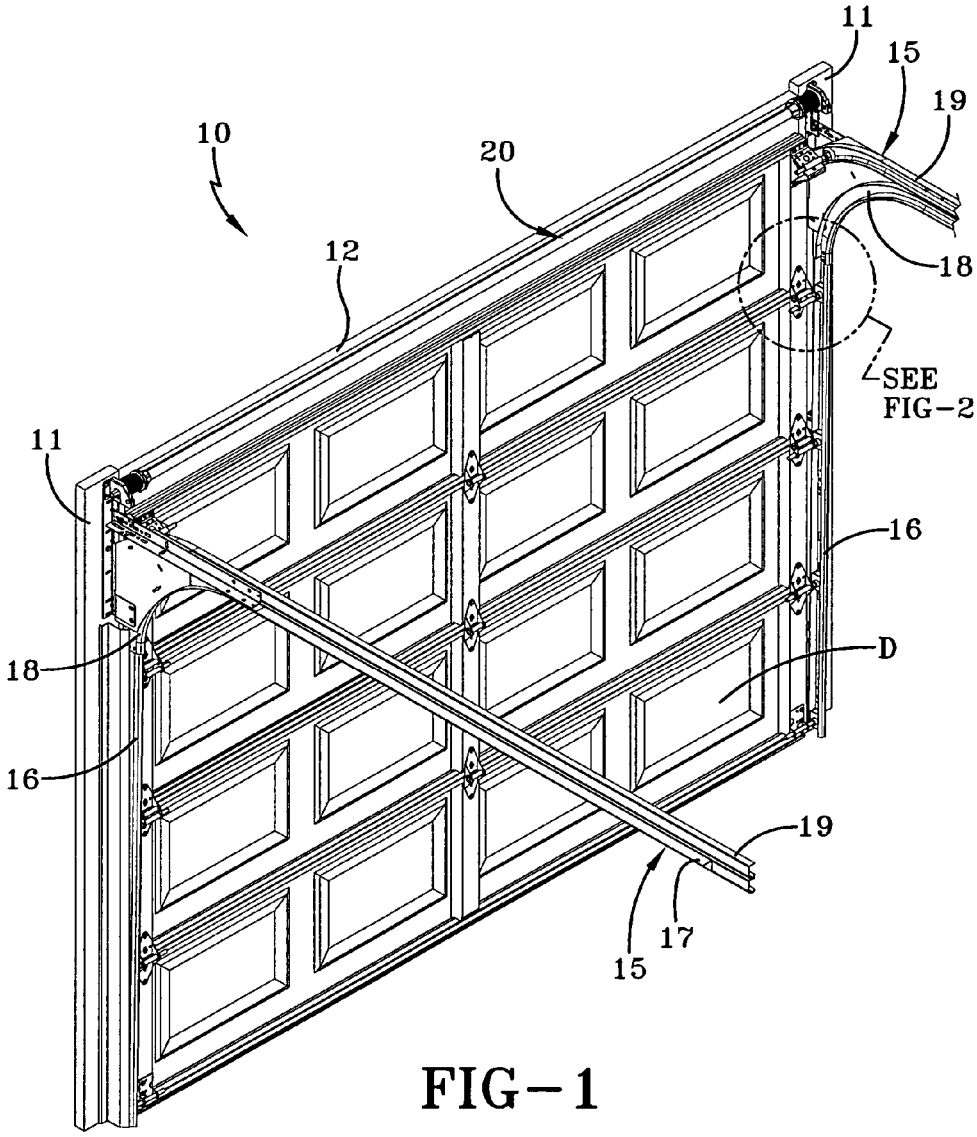
FIG. 1 is a rear perspective view of a door system including guide tracks attached to a framework that defines the door opening and rollers on the door engaging the track with guards according to the concepts of the present invention.

In general, door system 10 (FIG. 1) is mounted within an opening defined by a framework having a pair of spaced vertical jambs 11 connected by a laterally extending header 12 near the upper vertical extremity of the jambs 11. A door D resides within the opening and is moveable on a pair of guide track assemblies, generally indicated by the numeral 15, that guide the door D between a generally vertical closed position and a generally horizontal open position (not shown).

To offset the weight of the door D, as it is operated on guide track assemblies 15, a counterbalance assembly, generally indicated by the numeral 20, may be used in connection with the door D in a manner well known in the art. Guide track assemblies 15 include a generally vertical track section 16 and a generally horizontal track section 17 which are joined by a curved transition track section 18. In the track assemblies 15 shown, a second horizontal track section 19 is disposed above the horizontal track section 17.

Figures 4, 5, 5A:
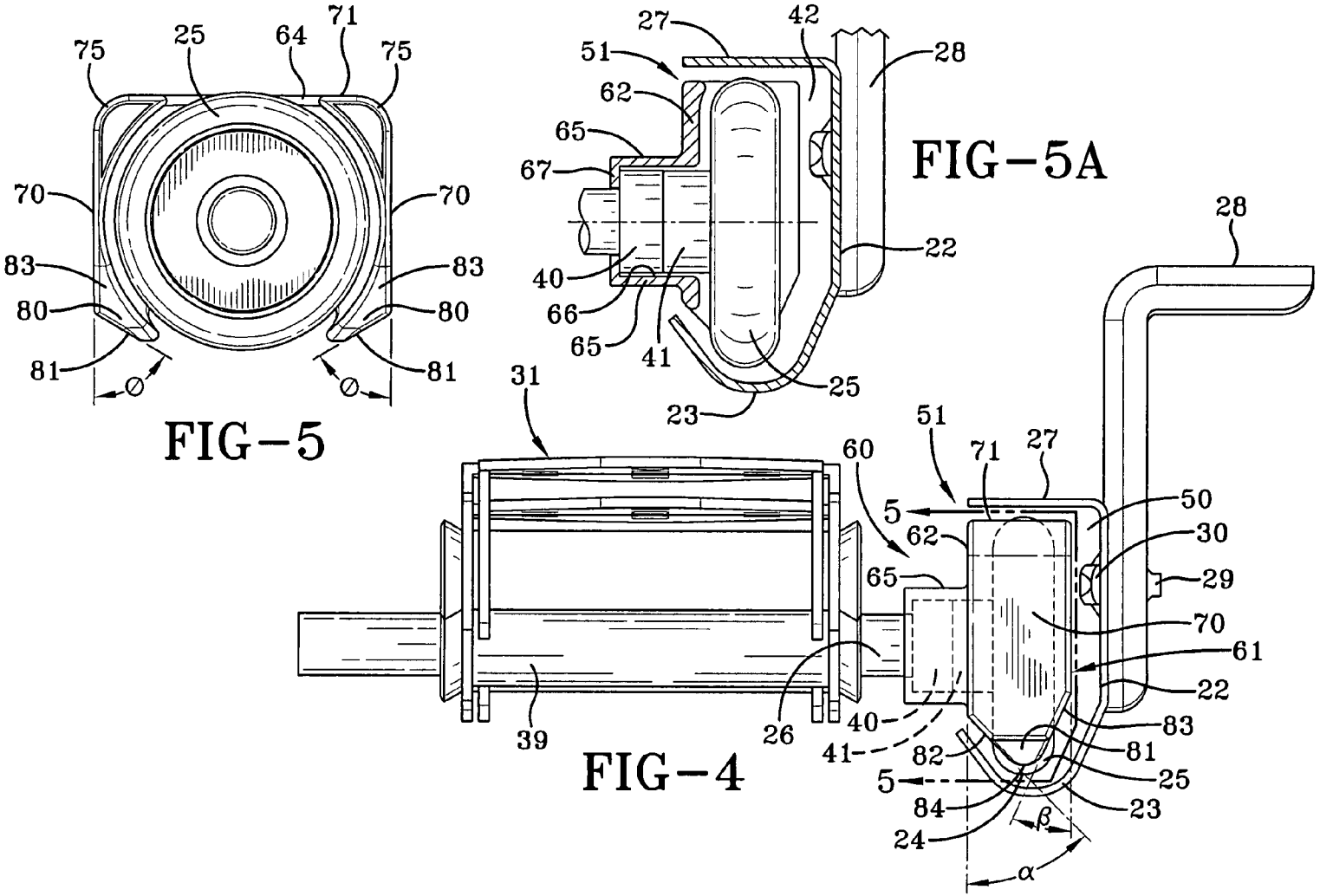
FIG. 4 is a top plan view of a roller guard and track section of the door system of FIG. 1.
FIG. 5 is a side elevational view of a roller guard taken substantially along line 5-5 of FIG. 4.
FIG. 5A is an elevational view of a roller, track and a roller guard with portions shown in section taken substantially along the line 5A-5A of FIG. 2.

Referring to FIGS. 1-4, track sections 16-20 receive rollers 25 of door D in arrangements known to persons skilled in the art. Referring particularly to FIG. 4, guide track assemblies 15 in cross section are of a generally J-shaped configuration, having an upstanding leg 22 with a U-shaped curve 23 proximate to one end for receiving the running surface 24 of a roller 25, which is mounted on the end of a shaft 26. The other end of the upstanding leg 22 has a lateral leg 27 that restrains excessive movement of the roller 25 from the U-shaped curve 23. Track assembles 15 are coupled to standoff brackets 28 attached to the vertical track sections 16 by a plurality of bolts 29 having heads 30 which located on the interior of track 15. While the present embodiment depicts a single vertical track design, it should be appreciated that the invention described herein is equally applicable to dual vertical track designs or any other roller track arrangements known in the art.

Figure 3:
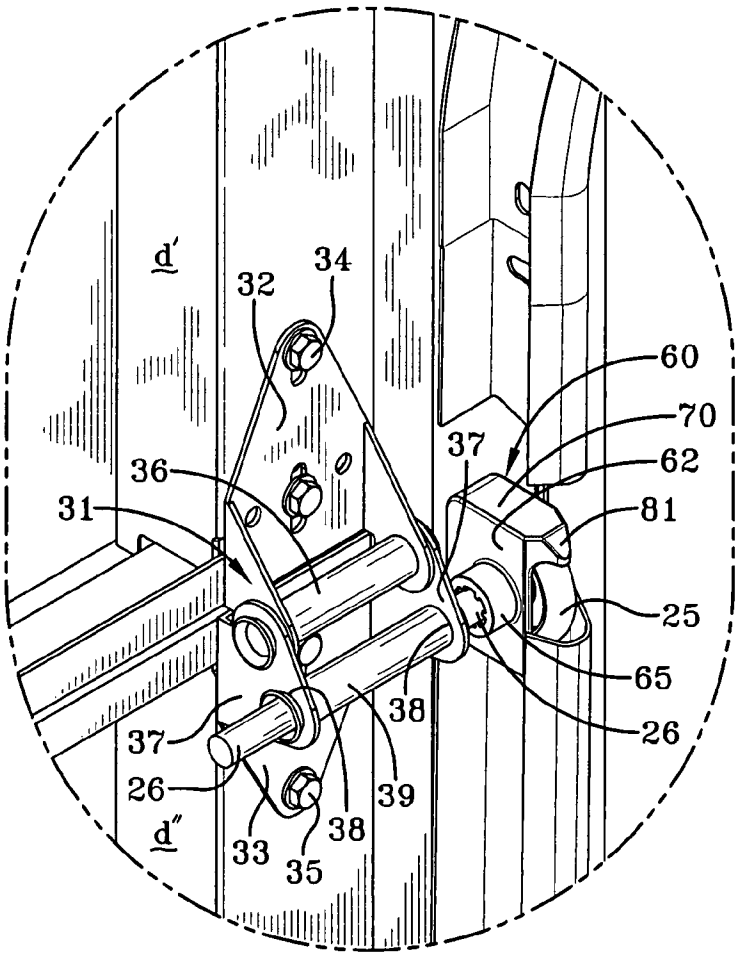
FIG. 3 is an enlarged fragmentary perspective view taken in the manner of FIG. 2, with a portion of the vertical track section cut away to show details of the interrelation between the track, a roller and the roller guard.
Figure 2:
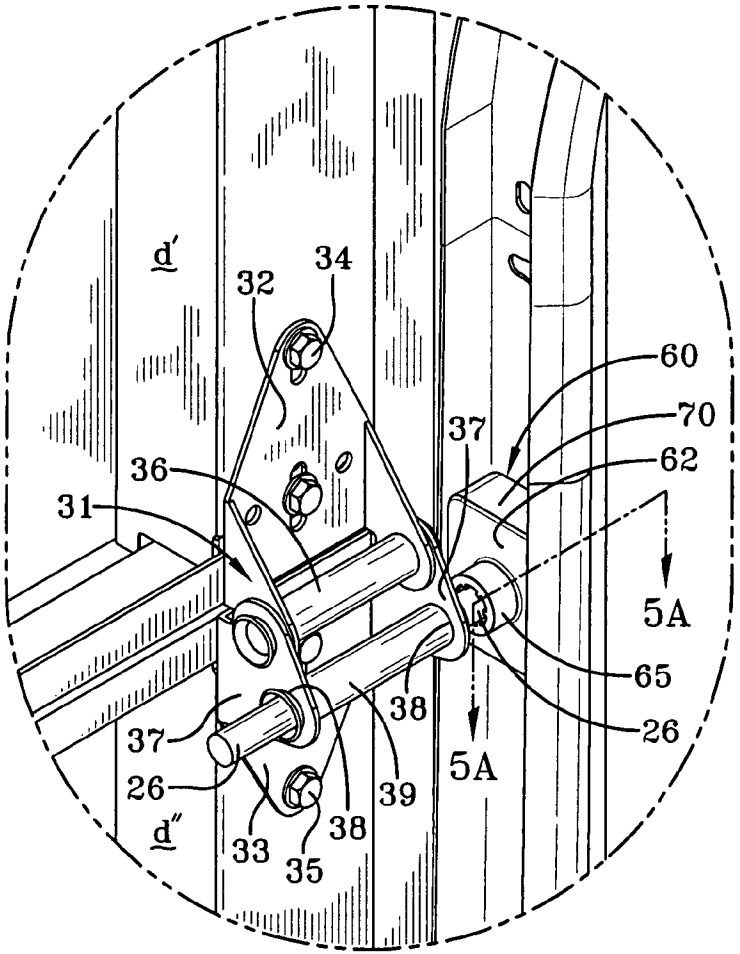
FIG. 2 is an enlarged fragmentary perspective view of the portion of FIG. 1 indicated thereon, showing additional details of the roller guard when positioned along the length of the vertical track section of the door.

As best shown in FIGS. 2 and 3, each shaft 26 may be secured to door D at a hinge, generally indicated by the numeral 31. Hinge 31 includes a first leaf 32 and a second leaf 33 pivotally attached to first leaf 32. First leaf 32 is mounted flush on a door panel d' and similarly secured thereto by a plurality of bolts 34. Second leaf 33 is mounted flush on an adjoining door panel d" and secured by a plurality of bolts 35. First and second leaves 32 and 33 are each secured to a pin 36 which allows relative pivotal movement of door panels d' and d". Second leaf 33 is provided with a pair of spaced flanges 37 which project away from door panel d". Each flange 37 is provided with an aperture 38. Secured between apertures 38, which are axially aligned, is a roller carrier 39 which is a hollow cylindrical tube adapted to slidably and removably receive a shaft 26 which mounts a roller 25. Roller 25 is provided with a bearing (not shown) which allows for free rotation relative to shaft 26. Shaft 26 also is free to move axially within roller carrier 39 during operation of door D.

Referring to FIGS. 4 and 5A, a first circumferential boss 40 may be provided on shaft 26 and has a radius greater than that of shaft 26. A second circumferential boss 41 having the same radius as the first boss 40 may further be provided and positioned between roller 25 and first boss 40. It should be appreciated that, while the present embodiment includes a pair of bosses, the invention described herein is applicable to roller and shaft designs which do not include bosses and other roller and shaft arrangements known in the art.

As best shown in FIG. 4, upstanding leg 22, U-shaped curve 23 and lateral leg 27 define an interior track cavity 50. Further, an opening 51 is defined between the lateral leg 27 and U-shaped curve 23 of track 15. As will be appreciated, objects entering opening 51 may interfere with the operation of the door D or be damaged as rollers 25 traverse track 15. Of particular concern is the entrapment of a hand or fingers within interior track cavity 50 during door operation. To prevent a foreign object, hand or finger from entering opening 51 proximate a roller 25, the roller guard, according to the concepts of the present invention, and, generally indicated by the numeral 60, is provided.

Figure 7:
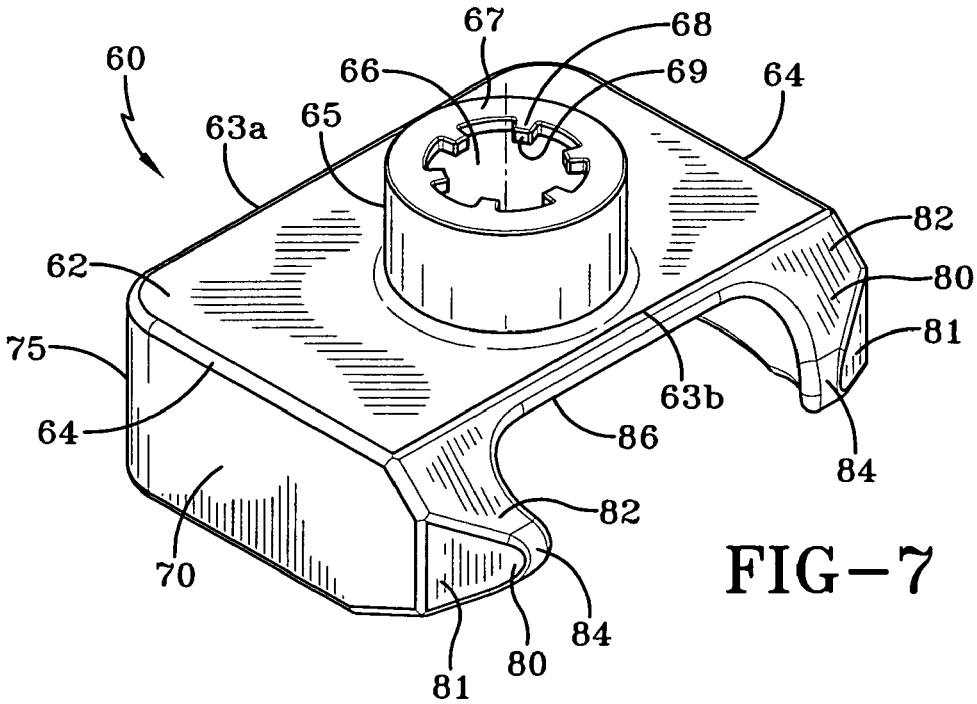
FIG. 7 is an enlarged isometric view of the roller guard according to the concepts of the present invention showing particularly the exterior configuration thereof.

As best shown in FIGS. 2-4, roller guard 60 is carried on shaft 26 and at least partially encompasses roller 25, so as to reduce the likelihood of crushing a foreign object or finger between tracks 15 and a roller 25. As shown, roller guard 60 is a single piece body 61 which, when installed, resides entirely within interior track cavity 50. Body 61 includes a shield wall 62 which, as seen in FIG. 5A, partially covers opening 51 when installed. As best seen in FIG. 7, shield wall 62 may be generally rectangular defining a pair of longitudinal edges 63*a* and 63*b* and a pair of lateral edges 64 wherein longitudinal edges 63*a* and 63*b* are joined by lateral edges 64.

Figure 6:
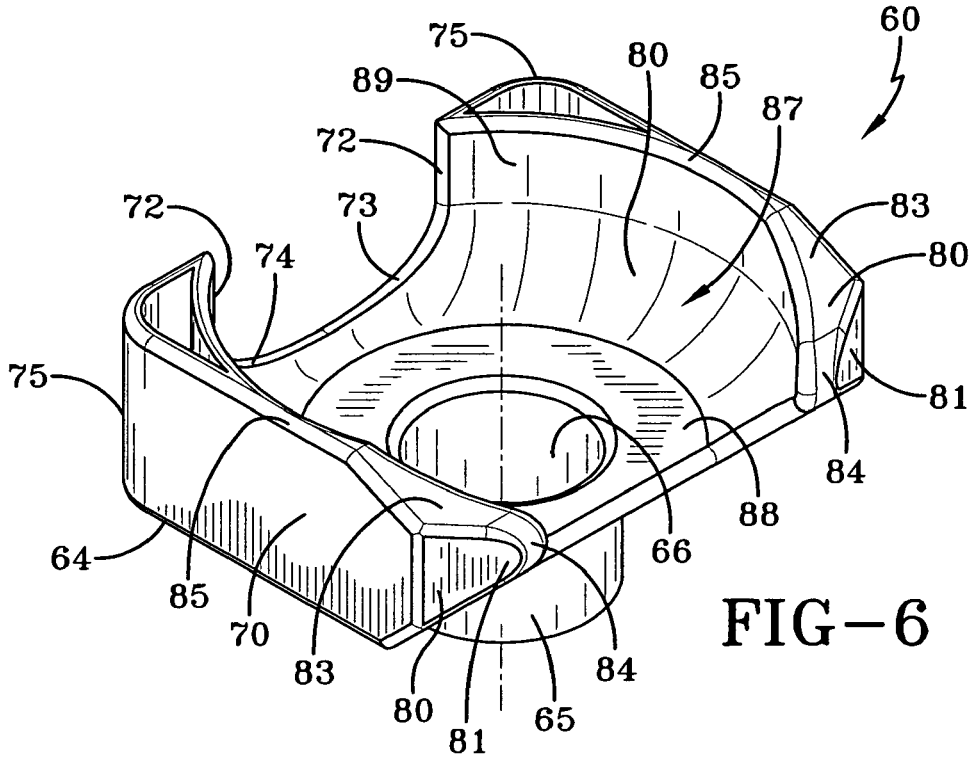
FIG. 6 is an enlarged isometric view of the roller guard according to the concepts of the present invention showing particularly the interior configuration thereof.

When roller shield 60 is mounted in tracks 15, shield wall 62 is generally parallel to upstanding leg 22, as is evident in FIG. 4, and may be positioned within and obstruct at least a portion of opening 51. Referring to FIGS. 5-7, an annular projection 65 may extend axially from shield wall 62 towards hinge 31. Extending through both shield wall 62 and annular projection 65 is a bore 66 which is adapted to receive circumferential bosses 40 and 41 therein. The diameter of bore 66 may be sized to provide a press fit when the roller guard 60 is installed over circumferential bosses 40 and 41. A circumferential flange 67 is provided at the end of annular projection 65 extending radially inward therefrom.

A plurality of circumferentially spaced tabs 68 are provided which extend radially inward from flange 67. Each tab 68 includes a contact surface 69 which may be positioned to engage shaft 26. Flange 67 and tabs 68 are sized so that when assembled, contact surfaces 69 of tabs 68 grip shaft 26. In this manner, the roller guard 60 is thereby restrained both axially and rotationally relative to shaft 26.

Referring to FIGS. 4-7, a pair of opposed sidewalls 70 project orthogonally from shield wall 62 at lateral edges 64 and a top wall 71 projects generally orthogonally from shield wall 62 at longitudinal edge 63*a*. Top wall 71 includes a pair of spaced edges 72 which extend towards shield wall 62 and are joined by a curved edge 73. Edges 72 and 73 define a groove 74 which allows a portion of roller 25 to project therethrough. In other words, when installed, a portion of roller 25 extends beyond top wall 71 to enable contact with lateral leg 27 of track 15 as best seen in FIGS. 4, 5 and 5A. Side walls 70 and top walls 71 intersect at edges 75. Edge 75 is radiused in order to prevent jamming of roller guard 60 within tract 15 as will be discussed later. In one or more preferred embodiments depending upon curvature of track 15 and other dimensions, the radius of edge 75 is from between 0.125 and 0.375 inches. In a particularly preferred embodiment the radius of edge 75 is 0.250 inches.

Body 61 is further provided with a pair of fingers 80 which are positioned at the bottom of roller guard 60 proximate to the U-shaped curve 23 in track 15 as seen in FIGS. 4, 5 and 5A. Fingers 80 project from side walls 60 on either side of roller 25. Fingers 80 are adapted to further prevent objects from being entrapped between roller 25 and track 15, while also preventing jamming as rollers 25 traverse track 15. Referring to FIGS. 4 and 5, fingers 80 include a beveled surface 81 which is disposed at an angle ∅from side walls 70. In one or more preferred embodiments, depending upon the curvature of track 15 and other dimensions, the angle ∅is between 45 and 70 degrees. In a particularly preferred embodiment the angle ∅is 60 degrees.

As seen in FIG. 4, fingers 80 in a direction axially of roller 25 include a first angled surface 82 and a second opposed angled surface 83 which are joined by a curved surface 84 in an open U-shaped configuration. First angled surface 82 is disposed at an angle α from shield wall 62. Second angled surface 83 is disposed at an angle β from an edge 85 defined by side wall 70. The angle α of first angled surface 82 is chosen to reduce contact with track 15. In one embodiment the angle α may be chosen so that it is generally parallel to the portion of track 15 which faces first angled surface 82 or so that running surface 24 of roller 25 engages the proximate surface of U-shaped curve 23 before angled surface 82 can engage the U-shaped curve 23. In another embodiment the angle α may be about 45°. Similarly, the angle β of second angled surface 83 is chosen to reduce contact with track 15. In one embodiment the angle β may be chosen so that it is generally parallel to the portion of track 15 which faces second angled surface 83 or so that running surface 24 of roller 25 engages the proximate surface of U-shaped curve 23 before angled surface 83 can engage the U-shaped curve 23. In another embodiment the angle β may be about 25°. Fingers 80 and shield wall 62 define a bottom groove 86 extending between fingers 80 which is adapted to allow a portion of roller 25 to extend therethrough. When installed, a portion of roller 25 extends beyond fingers 80 to provide contact with the U-shaped curve 23 of track 15.

As seen in FIG. 6, shield wall 62, side walls 70, top wall 71 and fingers 80 define a chamber 87 which receives roller 25 therein. Chamber 87 includes an annular surface 88 which projects radially outward from bore 66. A pair of roller surfaces 89 circumferentially surround roller 25 and terminate at edges 72 and fingers 80. Positioned between annular surface 88 and roller surface 89 is a curved surface 90, which smoothly connects the aforementioned surfaces. As is evident from FIG. 5, roller 25 resides in chamber 87 and, to that end, roller surfaces 89 define a diameter which is greater than that of roller 25 to allow free rotation therein.

Referring now to FIGS. 2-4, it can be seen that roller guard 60 is located axially of shaft 26, and when positioned over roller 25, will prevent objects from being crushed between track 15 and roller 25. When installed, roller guard 60 in cooperation with track 15 encloses roller 25, leaving no substantial part of roller 25 exposed to external objects. Further, as rollers 25 traverse track 15, side walls 70, edge 75 and beveled surface 81 push any intervening object harmlessly in front of guard 60.

As is evident from FIGS. 2 and 3, the body 61 of roller guard 60 resides within track 15. Particularly, shield wall 62, side walls 70, top wall 71, and fingers 80 are all positioned within the interior track cavity 50 defined by track assembly 15. Only annular projection 65 extends beyond opening 51, closely encircling bosses 40 and 41. Friction is minimized because no shielding surfaces remain in continuous contact with the track assembly. Additionally, roller guard 60 will not interfere with any external track system components. Further, due to its compact design, guard 60 can be installed on any of the rollers 25, including those located on the lowermost edge of door D.

It is to be appreciated that the guard 60 not only protects users from injury but does not encumber door movement. Therefore, the roller guard 60 of the present invention produces little friction and is not prone to jamming. Jamming is particularly a concern as roller guard 60 traverses a transitional track section 18, due to the curved orientation thereof. It should be appreciated that components of transitional track section 18 embody different radii of curvature.

Specifically, the radius of curvature of lateral leg 27 is larger than that of curved portion 23. In order to promote smooth operation, radiused edges 75 and beveled surface, 81 are provided. As discussed above, edge 75 is provided with a radius to reduce contact with lateral leg 27 while traversing track section 18.

Further, beveled edge 81 is disposed at angle ∅which reduces contact with curved section 23. While it is desired that the roller guard 60 contact the track assembly 15 as little as possible, it should be evident, that due to the orientation of the roller guard 60 within track assembly 15, some contact is necessary. Particularly, while traversing track section 18, beveled surface edge 81 and edges 75 intermittently contact track assembly 15 in order to progressively reorient the roller guard 60 therein. Such contact is only intermittent and edges 75 and 81 are adapted to reduce friction when such contact occurs. In this manner, guard 60 does not interfere with roller movement or unduly create frictional forces.

Thus, it should be evident that the roller guard for a movable barrier disclosed herein carries out one or more of the objects of the present invention set forth above and otherwise constitute an advantageous contribution to the art. As will be apparent to persons skilled in the art, modifications can be made to the preferred embodiments disclosed herein without departing from the spirit of the invention, the scope of the invention herein being limited solely by the scope of the attached claims.

The invention claimed is:

1. A door system comprising, a door, a plurality of track sections having a cross-section defining an interior track area that is accessible though an opening therein, a roller received in said interior track area and coupled to a shaft that is operatively interconnected with said door, and a guard carried by said shaft and at least partially enclosing said roller, said guard including a guard body, an annular projection, and a shield wall that lies on a plane perpendicular to said roller shaft and at least partially obstructs said opening in the area of said roller, said annular projection extending axially from said shield wall and receiving said shaft, wherein said guard is positioned entirely within said interior track area except for said annular projection.

2. The door system of claim 1, wherein said annular projection further includes a flange positioned on the end thereof and a plurality of tabs, wherein said flange and said tabs extends radially inward towards said shaft and said tabs are adapted to engage said shaft.

3. The door system of claim 1, wherein said guard includes a pair of opposed side walls and a top wall, each of which project orthogonally from said shield wall and away from said opening.

4. The door system of claim 3, wherein said top wall intersects with each said side wall at a corner, said corner being provided with a radius.

5. The door system of claim 4 wherein said radius of said corner is between 0.125 and 0.375 inches.

6. The door system of claim 4, wherein said track sections include a transition track section, said transition track section including a curved section and a lateral leg, wherein said lateral leg defines a radius of curvature greater than said curved section and said corners are positioned proximate to said lateral leg.

7. The door system of claim 3, wherein said guard further includes a pair of fingers positioned on opposed sides of said roller, said fingers including a beveled surface that is disposed at an angle to said side walls.

8. The door system of claim 7, wherein said beveled surface angle is between 45 and 70 degrees.

9. The door system of claim 7 wherein said track sections include a transition track section, said transition track section including a curved section and a lateral leg, wherein said lateral leg defines a radius of curvature greater than said curved section and said beveled surfaces are positioned proximate to said curved section.

10. The door system of claim 9, wherein said fingers have opposed surfaces that are angled in a direction partially axially of said roller so that said roller engages a proximate surface of curved section before said opposed surfaces engage said curved section to thereby avoid friction between said opposed surfaces and said track sections.

11. The door system of claim 10, wherein said opposed surfaces are joined by a curved surface.

12. A sectional door system comprising, a door, a plurality of track sections defining an interior track area that is accessible through an opening therein, a shaft mounted on said door and carrying a roller freely rotatably mounted thereon, said roller being movable in said track sections, and a guard having an annular projection to receive said shaft, said guard positioned within said interior track area and enclosing a substantial portion of said roller to prevent objects from being entrapped between said roller and said track, said guard having fingers configured to prevent engagement of said guard with said track sections during axial adjustments of said rollers in said track sections to avoid friction between said guard and said track sections, wherein said guard is positioned entirely within said interior track area except for said annular projection, said annular projection extending through said opening in said track sections.

13. A sectional door system according to claim 12, wherein said roller is axially fixed on said shaft and said shaft is freely axially movably mounted on said door.

14. A sectional door system according to claim 13, wherein said guard has a shield wall within said interior track area with said fingers projecting therefrom and having opposed surfaces angles in a direction partially axially of said roller so that said roller engages proximate surfaces of said interior track area before said shield can engage said track sections.

15. A sectional door system according to claim 14, wherein said guard has tabs gripping said shaft, whereby said guard is restrained axially and rotationally relative to said shaft.

16. A sectional door system according to claim 15, wherein said annular projection has a flange carrying said tabs and a bore to receive said shaft.

17. A sectional door system according to claim 12, wherein said fingers have beveled edges which together with a pair of radiused corners on said guard reorient said guard when said roller traverses said track sections.

18. A sectional door system according to claim 17, wherein a first groove between said radiused corners allows a portion of said roller to extend radially outwardly of said guard to engage said track sections and a second groove between said fingers allows a portion of said roller to extend radially outwardly of said guard to engage said track sections.

* * * * *